US006234940B1

(12) United States Patent
Fotsis

(10) Patent No.: US 6,234,940 B1
(45) Date of Patent: May 22, 2001

(54) TRAINING BAG

(76) Inventor: John Fotsis, 7304 W. Kiowa La., Palos Heights, IL (US) 60463

( * ) Notice: Subject to any disclaimer, the term of this patent is extended or adjusted under 35 U.S.C. 154(b) by 0 days.

(21) Appl. No.: 09/440,081

(22) Filed: Nov. 15, 1999

(51) Int. Cl.[7] ..... A63B 69/34

(52) U.S. Cl. ..... 482/83; 482/86; 482/87; 482/89

(58) Field of Search ..... 482/83, 87, 86, 482/89, 85, 88, 90

(56) References Cited

U.S. PATENT DOCUMENTS

| | | | | |
|---|---|---|---|---|
| 5,328,425 | | 7/1994 | Knighton et al. . | |
| 5,697,872 | | 12/1997 | Stronsick, Jr. et al. . | |
| 5,792,032 | * | 8/1998 | Williams et al. | 482/83 |
| 5,897,466 | | 4/1999 | Capach . | |
| 5,902,217 | | 5/1999 | Schechner et al. . | |
| 5,921,895 | * | 7/1999 | Lynch et al. | 482/83 |

* cited by examiner

*Primary Examiner*—Jerome W. Donnelly
*Assistant Examiner*—Lori Baker Amerson
(74) *Attorney, Agent, or Firm*—Knechtel, Demeur & Samlan

(57) ABSTRACT

A training bag designed to provide the user, a martial artist or boxer, with a training apparatus that simulates the response of a human body upon the execution of fighting techniques on the training bag and, thereby, enable the martial artist or boxer to practice and master the affects of those techniques on an opponent without injuring the opponent or themselves. The training bag comprises an inner core with a filler material and a filler covering material that provides the proper height and weight of a training bag. The training bag further comprises an outer core with an impact material and an outer covering material. The impact material provides the martial artist or boxer with the realistic sensation of contacting an opponent with the fighting techniques and the outer covering material covers the impact material and displays imprinted indicia, if desired.

20 Claims, 1 Drawing Sheet

FIG. 1
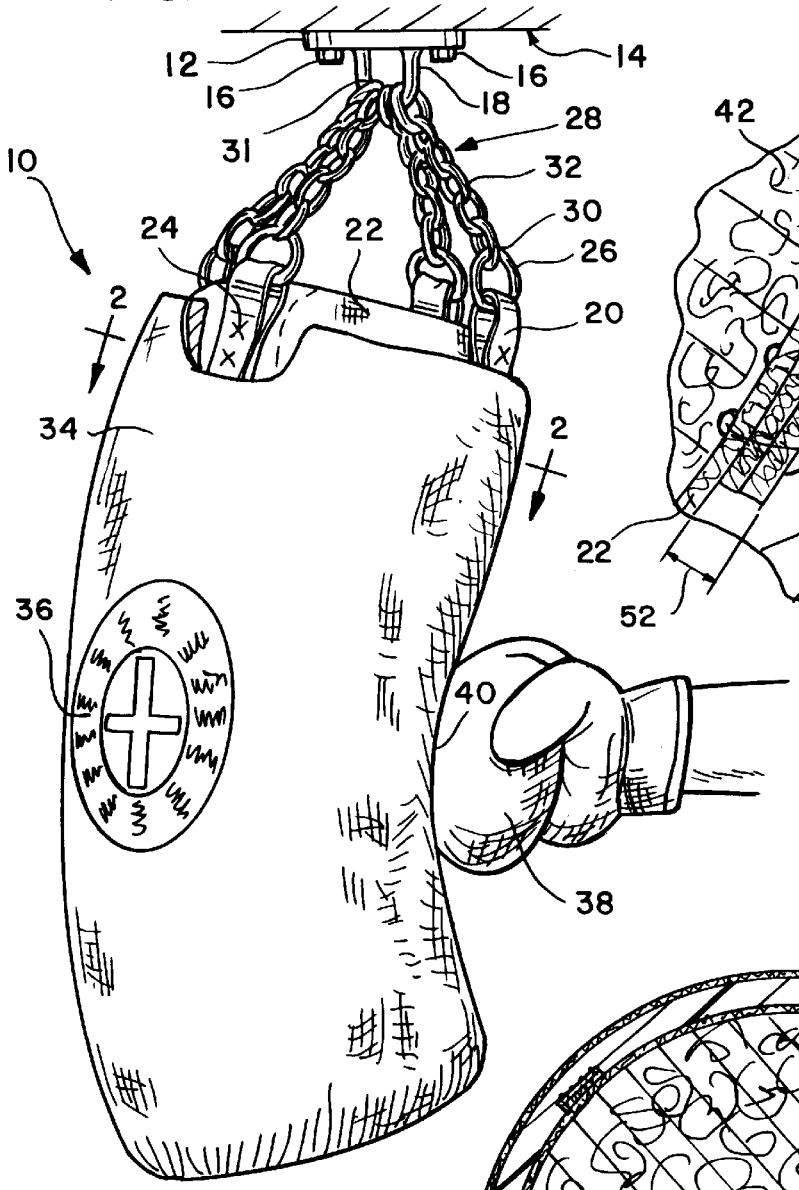
FIG. 3
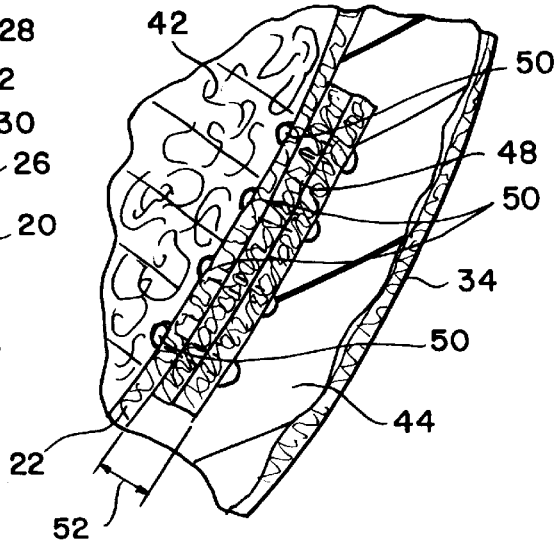
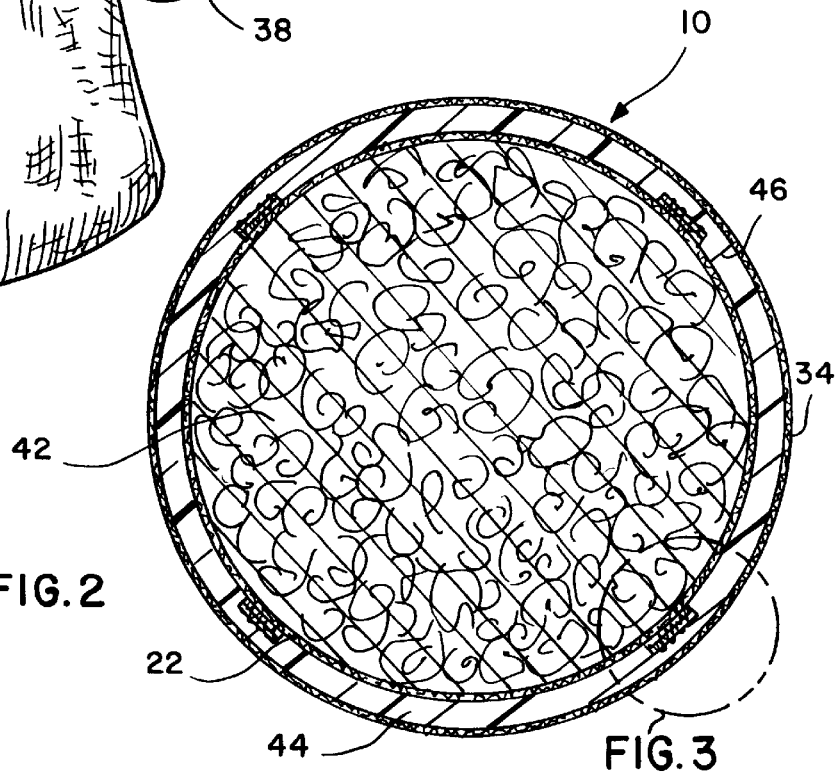
FIG. 2
FIG. 3

TRAINING BAG

I. FIELD OF THE INVENTION

The present invention relates to training bags and, more particularly, to a training bag that simulates the impact response of a human body upon the execution of a punch, kick, or a combination of both from a user such as a martial artist or boxer on the training bag.

II. DESCRIPTION OF THE PRIOR ART

Martial artists and boxers have used training bags to practice, develop, and master the individual punching and kicking techniques inherent in a particular discipline. Although the disciplines of the martial arts and boxers are different, they share one commonality, both are primarily designed to prepare for the engagement of a fight or combat with one or a number of other fighters. The other fighters may be those in competition as a sport or in self-defense against an attacker. The best means to train for such a fight is to practice the techniques learned against another martial artist or boxer who acts as the opposing fighter or attacker. However, to avoid injury, the martial artists and boxers fight in a controlled environment in which the martial artists and boxers do not complete the techniques learned or fully contact the opposing fighter. As a result, the martial artists and boxers never acquire the knowledge and skill that is gained from the complete execution of a combination or a flurry of combinations and the corresponding realistic sensation upon physically contacting the other fighter with the executed combinations.

To solve these problems, the training bag was implemented as an alternate method to simulate engagement with another fighter in which the training bag represents the body of a fighter or another human being. The typical training bag is elongated and cylindrical in shape, standing several feet high and a foot or two wide, and weighing between fifty to hundred or more pounds. The training bag is made of a filler material that is completely enclosed within a canvas material. Attached to the exterior of the canvas material at the top of the training bag are fasteners with hooks for insertion of a rope, chain, or other means to hang the training bag several inches to a few feet off the ground and, thereby, position the training bag within the primary contact zone of the martial artists and boxers. A shortcoming of this training bag is that the bag does not simulate the realistic response of a human being upon the execution of punches, kicks, or combinations on the bag. Rather, the bag is extremely hard and, therefore, does not yield to the contact through compression or absorption. Instead the bag moves in the direction opposite from the contact due to the reactive forces of the contact by the martial artist or boxer. Another shortcoming is that the exterior surface of the canvas material is very coarse and, therefore, is not suitable for use by a martial artist or boxer without boxing gloves.

Attempts have been made to design a training bag that more accurately represents the physical shape of a human being or opponent. For example, U.S. Pat. No. 5,328,425 to Knighton et al. entitled "Martial Arts Strike and Kick Bag" discloses a punching bag that has two cylindrical sections separated by one conical section. The top cylindrical section represents the head-and-shoulders region of an opponent's body. The middle conical section represents the torso region of an opponent's body and the lower cylindrical section represents the hip-to-knee region. A shortcoming of this punching bag is that although the bag is sectioned to represent the different regions of an opponent's body, those regions do not provide the a martial artist or boxer with a realistic affect that results from actual contact of a real opponent in those regions. Another shortcoming of this punching bag is that the trainer is required to hold the bag for the martial artist or boxer to prevent the bag from moving in response to contact by the martial artist or boxer.

The representational physical shape of a human body or opponent by the training bag has been extended to further simulate an opponent's arms and legs. For example, in U.S. Pat. No. 5,697,872 to Stronsick, Jr. et al. entitled "Martial Arts Training Device" discloses a training bag that has an elongated tubular member with an arcuate bend that is adapted to matingly engage the exterior of the training bag. The tubular member has two distal ends that simulate the arms and legs of an opponent for the martial artist or boxer to practice various fighting techniques. A shortcoming of this training bag is that although the extremities of an opponent are provided, a martial artist or boxer will not gain the knowledge of the realistic response of a human being or opponent from contact with the training bag. Another shortcoming is that the training bag reacts to the contact by the martial artist or boxer by moving in the opposite direction of the contact and, therefore, requires a trainer or another individual to secure the bag while in use by the martial artist or boxer.

Attempts have been made to solve the reactive movement of training bags by providing the training bag with devices to regulate the movement and position of the training bag while in use by a martial artist and boxer. For example, U.S. Pat. No. 5,897,466 to Capach entitled "Heavy Bag and Support Mechanism" discloses a support mechanism that allows the training bag to move in a variety of directions after being struck by a martial artist or boxer. The inventive device includes a support beam having an I-shaped cross section that is coupled with a swiveling rail and a rolling assembly. Likewise, U.S. Pat. No. 5,902,217 to Schechner et al. entitled "Martial Arts And Boxing Accessory Apparatus For Heavy Bag" discloses a training bag that has straps secured to the bag to prevent undesirable twisting in response to torque generated by impact and blocking movements on the training accessory that mounts to the bag. A shortcoming of these training bags is that neither provide the martial artist or boxer with the realistic sensation of training on the bag that results from actual physical contact with a human body or opponent. Another shortcoming of these training bags is that, upon execution of a punch or kick, the martial artist or boxer will be in a different position to execute a second punch or kick as the training bags do not properly simulate the impact response of a human being or opponent.

There is a need, therefore, and there has never been disclosed a training bag that simulates the impact response of a human being or opponent upon the execution of a punch, kick, or flurry of combinations on the training bag.

III. OBJECTS OF THE INVENTION

It is the primary object of the present invention to provide a training bag that simulates the impact response of a human body or an opponent upon the execution of a punch, kick, or a combination of both from a user such as a martial artist or boxer on the training bag. A related object of the present invention is to provide the martial artist or boxer with a realistic sensation of physical impact of a particular technique upon a human body or opponent that results from contact with the training bag.

Still another object of the present invention is to provide the martial artist or boxer with the ability to effectively execute subsequent punches, kicks, or further combinations of techniques with the knowledge and understanding of how the prior punch or kick affected the human body of an opponent. A related object of the present invention is to provide the martial artist or boxer with the proper balance and positioning to execute subsequent punches, kicks, or other techniques.

Another object of the present invention is to eliminate the necessity of a trainer or another individual to hold the training bag while in use by the martial artist or boxer. A related object of the present invention is to provide a training bag that does not automatically move in a direction opposite of the martial artist or boxer due to the reactive forces of the punch or kick on the training bag.

Still another related object of the present invention is to reduce the reactive forces sustained by the martial artist or boxer upon the execution of a punch, kick, or a combination of both on the training bag. A related object of the present invention is to reduce the physical stress absorbed by the martial artist or boxer and, thereby, permit the martial artist or boxer longer training sessions on the training bag.

Other objects of the present invention will become more apparent to persons having ordinary skill in the art to which the present invention pertains from the following description taken in conjunction with the accompanying drawings.

IV. SUMMARY OF THE INVENTION

The present invention is a training bag that provides a martial artist or boxer with the realistic sensation of actual contact with the human body of an opponent upon the execution of a punch, kick, or combination of both on the training bag. The training bag comprises an inner core and an outer core each with two main layers of material: the inner core has a filler material and a filler covering material and the outer core has an impact material and an outer covering material.

The filling material is contained within the filler covering material and provides the proper height and weight mass of the training bag. The filler covering material is covered with the impact material which is of the proper density and consistency to simulate the impact response of a human body or opponent. The impact material is covered by an outer covering material that protects the impact material from damage and permits easier use by the martial artist or boxer. The outer covering material is also adaptable to be imprinted with indicia or other forms of logos.

V. BRIEF DESCRIPTION OF THE DRAWINGS

The Description of the Preferred Embodiment will be better understood with reference to the following figures:

FIG. 1 is a side elevational view illustrating the impact response of the training bag while in use and upon contact by a martial artist or boxer.

FIG. 2 is top cross-sectional view, taken along line 2—2 of FIG. 1, illustrating the various materials that compose the training bag.

FIG. 3 is a an exploded cross-sectional top view of a section of FIG. 2 illustrating the attachment of the impact material to the filler covering material.

VI. DETAILED DESCRIPTION OF THE PREFERRED EMBODIMENT

Turning first to FIG. 1, there is illustrated a training bag 10 that is freely supported by a support mechanism 12. The support mechanism 12 is affixed to a ceiling 14 through bolts 16. The support mechanism 12 is provided with a central hook 18. The training bag 10 has fasteners 20 attached to a filler covering material 22. Preferably, the training bag 10 has at least four fasteners 20 and the fasteners 20 are cross-stitched to the filler covering material 22. The fasteners 20 have a loop 24 to secure fastener hooks 26. The fastener hooks 26 are inter-linked to a chain 28 at a proximal end 30. The chain 28 is provided with a number of links 32 that are linked at a distal end 31 with the central hook 18 of the support mechanism 12. Alternatively, the training bag 10 may be equipped with a different fastener means, attachment means, and support means provided each serve to effectively support the training bag 10. It is also contemplated that the training bag 10 may be equipped with a base to secure the training bag 10 to the ground and, thereby, permit use of the training bag 10 in areas where a support mechanism 12 is not suitable. The base may be filled with sand or water to provide sufficient weight to secure the training bag 10 to the ground.

The training bag 10 has an outer covering material 34. In the preferred embodiment, the outer covering material 34 is made of a stretchable encapsulating material referred to as and commonly sold under the name of spandex. The outer covering material 34 covers the entire exterior periphery of the training bag 10 and is stretched to provide a smooth surface to the user. The outer covering material 34 is depicted with imprinted indicia 36. Preferably, the imprinted indicia 36 may be a graphical design, symbol, logo, words, or any combination thereof Alternatively, the imprinted indica 36 may be a picture or silhouette of a human body or an opponent illustrating the different regions of the body such as head, shoulders, chest, and stomach.

The training bag 10 is illustrated as being struck by a martial artist or boxer. For illustration purposes, the martial artist or boxer is equipped with a boxing glove 38 and is striking the training bag 10 with a punch at contact point 40. Alternatively, the martial artist or boxer could strike the training bag 10 with a bare hand, foot, elbow, knee, or head using any technique without the need for a glove 3 8 or other protective device. Upon impact of the training bag 10 at contact point 40 by the martial artist or boxer, the training bag 10 absorbs the impact and correspondingly compresses to yield to the contact. With the absorption of the contact, the training bag 10 does not laterally move in the opposite direction of the martial artist or boxer as the reactive forces are reduced by the absorption. This eliminates the necessity of a trainer or other individual to hold the training bag 10 while in use by the user. In the preferred embodiment, the impact upon the training bag 10 and corresponding compression or yielding to the contact simulates the actual physical contact with the human body of an opponent. With the training bag 10 providing the martial artist or boxer with the realistic sensation of the resulting impact of contact upon an opponent, the martial artist or boxer is capable of mastering the individual punching and kicking techniques inherent in a desired discipline. The martial artist or boxer is then able to learn the proper balance and positioning techniques to execute subsequent punches or kicks and, thereby, master the ability to perform a flurry of combinations or successive punches or kicks in an effective manner and as anticipated in response to the human body as a result of the prior punch or kick. The absorption of the contact by the training bag 10 also reduces the physical stress received by the martial artist or boxer which enables the martial artist or boxer to have longer workout periods or training sessions, if desired.

Turning to FIG. 2, the materials that enable the training bag 10 to simulate the impact response of a human body are represented. The inner core of the training bag 10 has in part a filler material 42. In the preferred embodiment, the filler material 42 is sand. Alternatively, the filler material 42 may be any other material provided it is of the proper density sufficient to produce the desired corresponding weight for a training bag in relation to the bags height and thickness.

The filler material 42 is completely enclosed within the filler covering material 22. In the preferred embodiment, the filler covering material 22 is made of a canvas material. Alternatively, the filler covering material 22 may be any other material provided the material has similar characteristics as canvas such as being heavy to contain the filler material 42 and having a coarse exterior as discussed further below and detailed in FIG. 3.

The filler covering material 22 is covered by an impact material 44. The impact material 44 covers the entire periphery of the filler covering material 22. In the preferred embodiment, the impact material 44 is made of a silicone gel. The silicone gel provides a similar density and consistency characteristics of a human body and, therefore, enables the training bag 10 to simulate the impact response of a human body upon being struck by a punch or kick and provide the martial artist or boxer who delivered the punch or kick to experience the realistic sensation of executing such punch or kick on a human body or opponent.

In the preferred embodiment, the impact material 44 has a thickness 46. The thickness 46 is between approximately one half an inch to two inches. Preferably, the thickness 46 should remain constant around the entire periphery of the training bag 10 to provide the user with consistent impact responses to contact anywhere on the training bag 10. For a thickness 46 that is less than approximately one half an inch, the impact material 44 does not provide sufficient density and consistency to simulate that of a human body and of a proper impact response. For a thickness 46 that is greater than approximately two inches, the density and consistency may simulate that of much larger or obese individuals. However, at larger thicknesses 46, the impact material 44 begins to lose its viscous characteristics and succumb to gravity. As a result, the impact material 44 no longer maintains a constant thickness 46 around the periphery of the filler covering material 22 of the training bag 10 as the exterior portions of the impact material 44 flow toward the bottom of the training bag 10.

Preferably, the impact material 44 is fused by heat to the exterior periphery of the filler covering material 22. Using fusion to unite the impact material 44 to the filler covering material 22 provides an impenetrable bond between the materials that enables the impact material 44 to withstand constant impact and use in a training bag. Refer to FIG. 3 for a detailed discussion of the fusion of the impact material 44 to the filler covering material 22.

The impact material 44 is covered by the outer covering material 34. The outer covering material 34 covers the entire periphery of the impact material 44 and, as enumerated in FIG. 1, is of a stretchable encapsulating spandex type material. The outer covering material 34 is a thin covering and provides protection for the impact material 44. The outer covering material 34 also aids in the aesthetic appearance of the training bag 10 and, as enumerated in FIG. 1, provides imprinted indicia 36 for advertisement, informational, or training purposes. It is contemplated that other materials may be used as the outer covering material 34 provided it is a thin layer and does not impede the impact response of the impact material 44.

FIG. 3 illustrates the fusion of the impact material 44 to the filler covering material 22. As indicated in FIG. 2, the filler covering material 22 is preferably made of a canvas material due to its coarse exterior. When the impact material 44 is fused to the filler covering material 22, a fusion layer 48 results. In the preferred embodiment, the fusion is accomplished by means of heat. When the heat is applied to the impact material 44, the impact material 44 reacts with the heat and seals into the coarse exterior of the filler covering material 22. As a result, the impact material 44 interfaces with all the imperfections 50 of the coarse exterior of the filler covering material 22 and, therefore, creates the fusion layer 48 that secures the impact material 44 to the filler covering material 22. Preferably, the impact material 44 is fused to the entire periphery of the filler covering material 44.

In the preferred embodiment, the fusion layer 48 has a fusion thickness 52 which is less than the thickness 46 of the impact material 44. The impact material 44 that is not within the fusion layer 48 remains in a static position with respect to the training bag.

Thus, there has been provided a training bag designed to simulate the response of a human body upon the impact of a punch, kick, or combination of punches and kicks on the training bag. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A training bag that characterizes the impact response of a human body, comprising:

a canvas material having an interior surface and an exterior surface;

a filler material completely contained within the interior surface of the canvas material whereby the canvas material and the filler material combine to form an elongated and cylindrical shape;

a silicone gel fused to the exterior surface of the canvas material;

a stretchable encapsulating material having an inner surface and an outer surface, the inner surface engaging the silicone gel, the outer surface remaining exposed for contact by a user; and means for supporting the training bag including the canvas, the filler material, the silicone gel, and the encapsulating material in a vertical orientation for use of the training bag by the user.

2. The training bag of claim 1 wherein the filler material is made of sand.

3. The training bag of claim 1 wherein the silicone gel is fused to the exterior surface of the canvas through heat.

4. The training bag of claim 1 wherein the silicone gel is less than approximately two inches in thickness.

5. The training bag of claim 1 and further comprising an indicia imprinted on the outer surface of the stretchable encapsulating material.

6. A training bag that characterizes the impact response of a human body, comprising:

a filler covering material having an interior surface and an exterior surface;

a filler material completely enclosed within the interior surface of the filler covering material to form an inner core;

a means for simulating around the exterior periphery of the inner core the impact response of a human body by providing a training bag that enables a user to experience the realistic sensation of actual contact with a human body through the execution of force upon the training bag by the user; and means for supporting the training bag including the filler covering material and the filler material in a vertical orientation for use of the training bag by the user.

7. The training bag of claim 6 wherein the means for simulating the impact response of a human body is through a silicone gel secured to the filler covering material.

8. The training bag of claim 7 wherein the silicone gel is secured to the filler covering material through fusion.

9. The training bag of claim 8 wherein the fusion of the silicone gel to the filler covering material is by heat.

10. The training bag of claim 9 wherein the silicone gel is provided in a layer less than two inches in thickness.

11. The training bag of claim 7 and further comprising an outer covering material having an inner surface and an outer surface, the inner surface engaging the silicone gel, the outer surface remaining exposed.

12. The training bag of claim 11 wherein the outer covering material is made of a stretchable encapsulating material.

13. The training bag of claim 11 and further comprising an indicia imprinted to the outer covering material.

14. A training bag that simulates the impact response of a human being upon the execution of punches, kicks, or a combination of punches or kicks on the training bag, comprising:

a filler covering material having a first surface and a second surface;

a filler material enclosed within the first surface of the filler covering material whereby the filler material and the filler covering material combine to form an elongated and cylindrical shape;

an impact material secured to the second surface of the filler covering material, the impact material yielding to the impact of a punch or kick by a user to simulate the response of a human body being impacted by the same punch or kick thereby enabling the user to experience the realistic sensation of actual contact with a human body through the execution of force upon the impact material of the training bag by the user; and means for supporting the training bag including the filler covering material, the filler material, and the impact material in a vertical orientation for use of the training bag by the user.

15. The training bag of claim 14 wherein the filler material is sand.

16. The training bag of claim 14 wherein the filler covering material is made of canvas.

17. The training bag of claim 14 wherein the impact material is made of a silicone gel material.

18. The training bag of claim 17 wherein the silicone gel material is secured to the second surface of the filler covering material through fusion by heat in which the fusion of the silicone gel material and the filler covering material form a resulting fusion layer.

19. The training bag of claim 14 and further comprising an outer covering material, the outer covering material having a first surface and a second surface, the first surface engaging the impact material, the second surface remaining exposed and displaying imprinted indicia.

20. The training bag of claim 19 wherein the outer covering material is made of a stretchable encapsulating material.

* * * * *